US007683847B2

(12) United States Patent
Byrne et al.

(10) Patent No.: US 7,683,847 B2
(45) Date of Patent: Mar. 23, 2010

(54) ANTENNAS

(75) Inventors: Graeme Byrne, West Lothian (GB); Ronald William Lyon, Midlothan (GB); Robert Ian Henderson, Chelmsford (GB)

(73) Assignee: Selex Sensors and Airborne Systems Limited, Basildon Essex (GB)

( * ) Notice: Subject to any disclaimer, the term of this patent is extended or adjusted under 35 U.S.C. 154(b) by 402 days.

(21) Appl. No.: 11/659,546

(22) PCT Filed: Nov. 14, 2006

(86) PCT No.: PCT/GB2006/050387

§ 371 (c)(1),
(2), (4) Date: Feb. 6, 2007

(87) PCT Pub. No.: WO2007/060477

PCT Pub. Date: May 31, 2007

(65) Prior Publication Data

US 2009/0102734 A1 Apr. 23, 2009

(30) Foreign Application Priority Data

Nov. 23, 2005 (EP) ..... 05257197
Nov. 23, 2005 (GB) ..... 0523818.3

(51) Int. Cl.
*H01Q 13/10* (2006.01)

(52) U.S. Cl. ..... 343/770; 343/767

(58) Field of Classification Search ..... 343/770, 343/767, 700 MS
See application file for complete search history.

(56) References Cited

U.S. PATENT DOCUMENTS

| | | | | |
|---|---|---|---|---|
| 3,836,976 | A | 9/1974 | Monser et al. | |
| 5,023,623 | A * | 6/1991 | Kreinheder et al. | 343/725 |
| 5,268,701 | A | 12/1993 | Smith | |
| 5,309,165 | A * | 5/1994 | Segal et al. | 343/770 |
| 5,845,391 | A * | 12/1998 | Bellus et al. | 29/600 |
| 6,239,761 | B1 * | 5/2001 | Guo et al. | 343/767 |
| 6,317,094 | B1 | 11/2001 | Wu et al. | |
| 6,525,696 | B2 * | 2/2003 | Powell et al. | 343/770 |
| 6,850,204 | B1 | 2/2005 | Angelucci | |

(Continued)

FOREIGN PATENT DOCUMENTS

EP 0 349 069 A1 6/1989

(Continued)

OTHER PUBLICATIONS

"Radiation pattern of short constant-width slot antenna", W.K. Ofosu and D. Mirshekar-Syahkal, Electronics Letters, Jan. 5, 1995, vol. 31, No. 1, pp. 7 and 8.

(Continued)

*Primary Examiner*—Hoang V Nguyen
(74) *Attorney, Agent, or Firm*—Crowell & Moring LLP

(57) ABSTRACT

This invention relates to a radiating element 20 for use in array antennas. The radiating element 20 is of simplified design and comprises a front region 26 and a rearward region 28 that are preferably substantially rectangular, which permit higher frequency limits than more conventional Vivaldi elements while maintaining the lower frequency limit. Additionally, by deployment of an array of a plurality of such elements 20 such that no gaps are formed between adjacent elements 20 along the array antenna, very wide bandwidth can be obtained using the array.

13 Claims, 3 Drawing Sheets

U.S. PATENT DOCUMENTS

| | | | | |
|---|---|---|---|---|
| 2004/0004580 | A1 | 1/2004 | Toland et al. | |
| 2006/0152426 | A1 * | 7/2006 | McGrath et al. | 343/770 |

FOREIGN PATENT DOCUMENTS

| | | | |
|---|---|---|---|
| EP | 0 831 550 | A1 | 3/1998 |
| JP | 2001-320225 | A | 11/2001 |
| WO | WO 97 15094 | | 4/1997 |

OTHER PUBLICATIONS

"Full and Partial Crosswalls Between Unit Cells of Endfire Slotline Arrays", Greogry J. Wunsch and Daniel H. Schaubert, IEEE Transactions on Antennas and Propagation, vol. 48, No. 6, Jun. 6, 2000 (XP-000959055).

European Office Action dated Jul. 31, 2009 (Four (4) pages).

Document titled "Patent Ref XA2003—Antenna," R. W. Lyon, 4 pages, Nov. 18, 2009.

* cited by examiner

ANTENNAS

This application is a 371 of PCT/GB06/50387 dated Nov. 14, 2006.

This invention is concerned with antennas and is more specifically concerned with notch radiating elements used in antenna arrays.

Radiating elements are small antennas that have a wide radiation pattern. They are used as the individual radiating elements in an electronically scanned array antenna (ESCAN). The elements are normally arranged on a rectangular or triangular grid with a transmit/receive module (TRM) behind each element. These TRMs contain phase shifters that enable the antenna main beam to be steered by choosing a set of amplitude and phase weightings that represent a particular beam angle.

A class of such antennas that have become widely adopted are called Tapered Slot Antennas (TSA) or Vivaldi elements. One advantage of these TSA or Vivaldi elements is that they are readily manufactured by printing onto a commercial microwave printed circuit board. An array of these elements comprises two boards, each having tapered slots printed onto the outside surfaces. A transmission input line, known as a stripline, is located between the boards, on their inner surfaces, before the boards are bonded together. Such a known design is illustrated in FIG. 1. It is also known to construct an array of these elements having just a single board with tapered slots printed on one side and a transmission input line bonded to the other side.

Vivaldi elements are now well known and a number of different designs thereof have been proposed to fulfil different requirements. It is important in designing these elements to ensure that almost all of the power that is fed into the element via the stripline 11 is actually radiated into free space via the tapered slot 12 at the top of the element (see FIG. 1). One common problem is that the power input may be reflected back from the stripline input port 13 rather than being radiated. Furthermore, the mutual coupling between the elements in the array also contributes to this reflected power. It is important to ensure, when designing these elements, that the reflected power (reflection coefficient) is minimised over all scan angles and frequencies at which the array operates. Conventionally, a radiating element is designed to operate over a range of angles within a cone having a 60-degree semi angle.

Each of the elements 10 shown in FIG. 1 has a length L, measured in a direction normal to the edge of the substrate. Length L is typically 1-2 times the wavelength of the radiation that the element generates, in order to allow operation over wide bandwidths. The bandwidth achieved is typically greater than one octave when employed in free space.

The spacing between adjacent elements of an array antenna, a portion of which is shown in FIG. 2, must be less than half a wavelength at the maximum operating frequency, in a rectangular grid, in order to prevent grating lobes (images of the main beam) occurring. This has the effect of limiting the lowest operating frequency, where the wavelength is longest, because the elements need to be wider where the wavelength is longest. However, this dimension is constrained because the spacing between adjacent elements must be less than half a wavelength at the top of the band to prevent the occurrence of grating lobes.

Further, to increase the upper frequency at which a Vivaldi element operates in an ESCAN array, it is necessary to reduce the physical separation between the elements from, for example, about 15 mm for a theoretical 10 GHz upper limit to about 7.5 mm for a theoretical 20 GHz upper limit. This has the effect of further limiting the lower frequency at which the elements can operate, because the slot of the element is not wide enough for wavelengths at the bottom end of the band.

As such, the present invention provides a radiating element and preferably an array antenna that seek to address the above limitations.

Accordingly, the present invention provides a notch element for an array antenna, the notch element being formed on a substrate and comprising a front region and a rearward region, wherein the front region is adjacent to an edge of the substrate and is shaped as a symmetrical polygon e.g. a rectangle, having an axis of symmetry normal to the edge of the substrate, wherein the notch elements are situated directly adjacent to one another with no gap there between.

Preferably, the front region has a dimension parallel to the edge that may be greater than its dimension normal to the edge. Further, it is preferable that the rearward region is shaped as a polygon having an axis of symmetry normal to the edge of the substrate. Still further, it is preferable that the rearward region has a dimension parallel to the edge smaller than its dimension normal to the edge.

Preferably, the axis of symmetry normal to the edge of the substrate may be the same for both front and rearward regions. Further preferably, the front and rearward regions are both substantially rectangular. It is preferable to provide a plurality of these notch elements on a substrate in a uniformly spaced arrangement.

Preferably, an electrically conductive stripline is provided for coupling the notch elements to a common source.

It is also possible for the notch elements are provided on only one surface of the substrate. Preferably, the substrate has opposed major surfaces, a layer of conductive material being provided on each major surface, and an array of said notch elements being formed by the layer of conductive material on each major surface so that the notch elements on each major surface are in alignment and in correspondence with the other. It is preferable that the notch elements are aligned along an edge thereof in said uniformly spaced arrangement.

It should be understood that the notch elements may be provided having different shapes to that described below in the embodiments of the invention.

Specific embodiments of the invention will now be described, by way of example only, with reference to the accompanying drawings that have like reference numerals, wherein.

Figure 4:
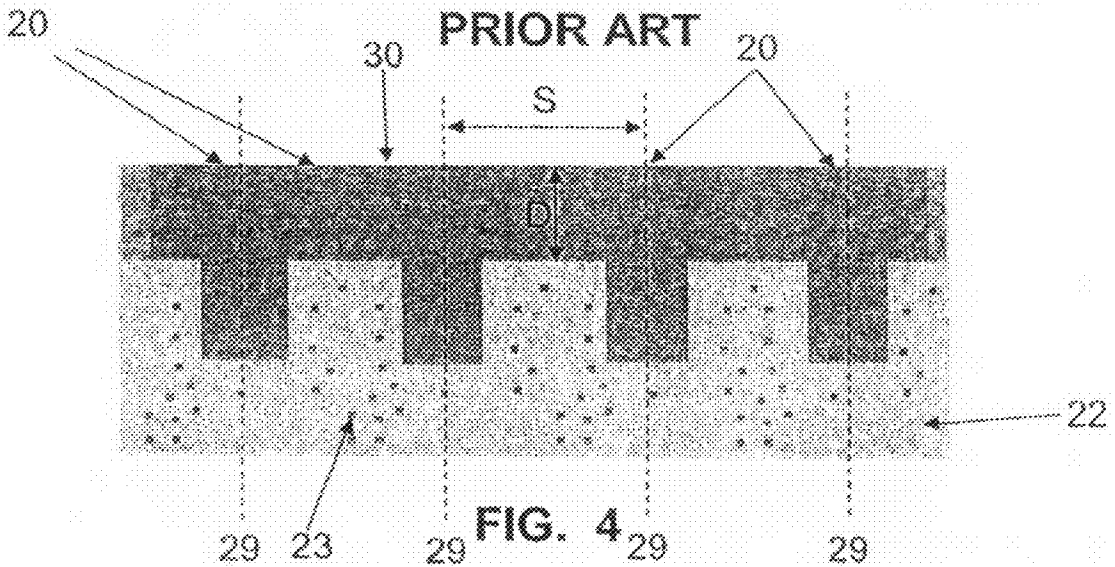
Figure 5A:
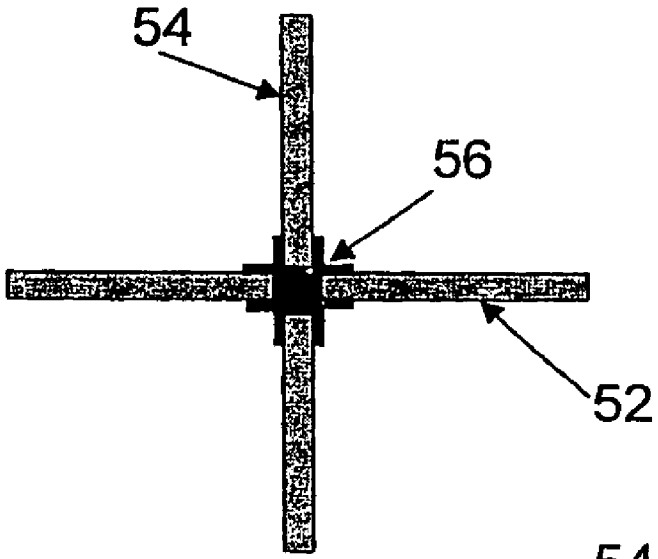
Figure 5B:
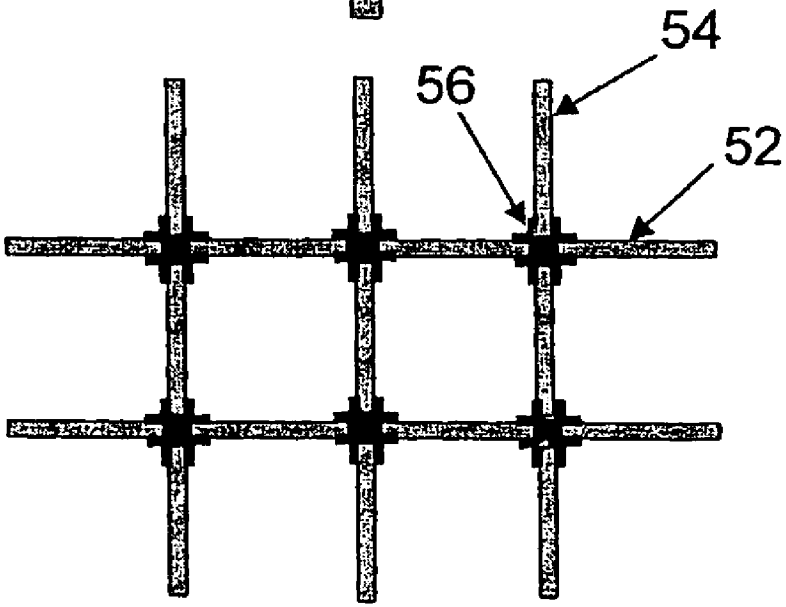

FIG. 4 is a diagrammatic illustration of a part of one surface of an array antenna illustrating four adjacent notch elements provided at an edge of a substrate of an array antenna in accordance with one aspect of the present invention; and FIGS. 5A and 5B are diagrammatic views of arrangements of notch elements according to the present invention arranged in a 90 degree grid to provide dual polarised wide band operation.

Figure 3:
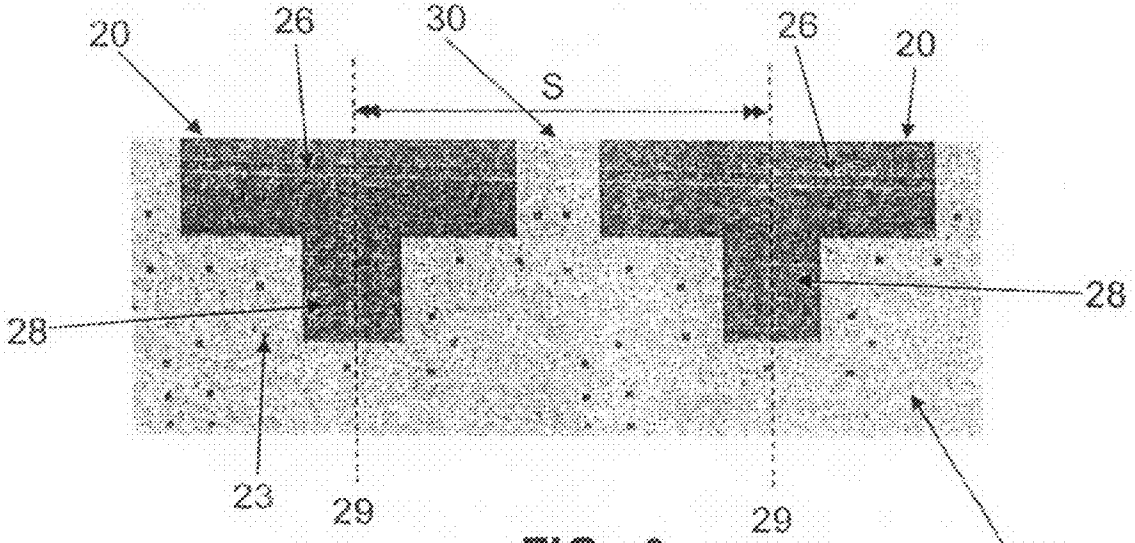
FIG. 3 PRIOR ART
FIG. 3 is a diagrammatic illustration of a part of one surface of an array antenna illustrating two adjacent notch elements provided at an edge of a substrate of an array antenna.

To address the problems of the prior art as discussed above, there can be provided a simple notch element profile, as shown in FIG. 3, which illustrates a pair of adjacent such elements in an array thereof. Each element 20 is formed by removing the coating from a substrate 22 coated with an electrically conductive material in a conventional manner.

Figure 1:
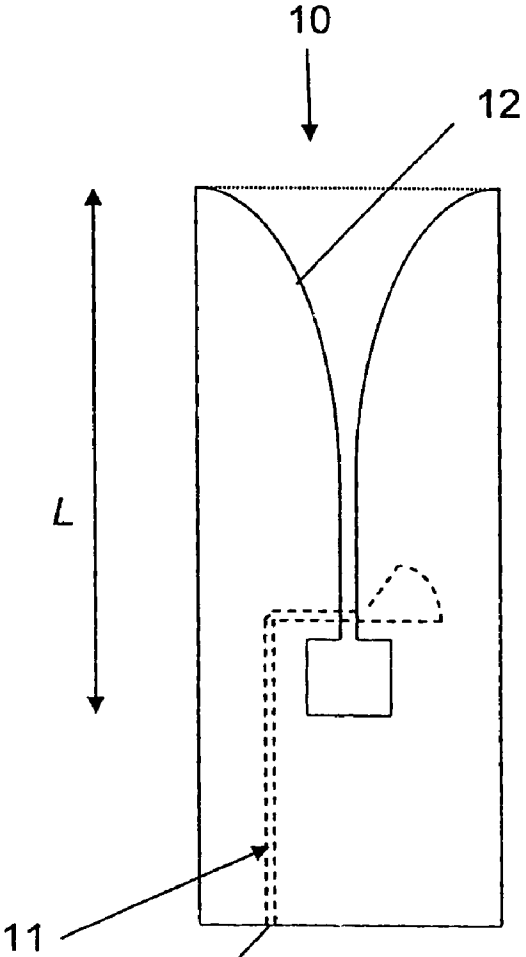
FIG. 1 PRIOR ART
FIG. 1 is a diagrammatic illustration of a part of one surface of an array antenna illustrating a Tapered Slot Antenna (TSA) or Vivaldi elements, as known in the art.

The elements formed are less than ½ the height of the comparable Vivaldi radiating element shown in FIG. 1 (i.e. have a length of approximately one half wavelength at the centre frequency). In this arrangement, it is to be understood that the substrate is formed as a laminate with a stripline sandwiched between the layers of the laminate. The layers of the laminate are provided by two printed circuit boards arranged in a back-to-back relationship and the reverse side (not shown in FIG. 3) of the laminate is substantially similar to the view shown in FIG. 3 as the elements are aligned on the two external surfaces. The external surfaces of the laminated substrate are electrically coupled by vias 23 extending through the substrate. It should be noted that the arrangement of the vias 23 is an arbitrary choice by a skilled designer, so other options than that shown are available.

Preferably, each element or array of elements are made using two boards, each board comprising a dielectric material having a copper layer coating both sides. For a first board, areas of the metal coating are removed from one surface to form the elements and from the other surface to form the stripline feed. For a second board, areas of the metal coating are similarly removed to form the elements and the other side has all of the metal coating removed. The two boards are bonded together so that the elements are provided on the outer facing surfaces and a stripline feed is provided in the middle, between the inner surfaces of the boards.

As can be seen from FIG. 3, the notch elements 20 each comprise a front region 26 which is rectangular in shape, and a rearward or inner region 28 which is also rectangular in shape. The two regions are centred on an axis 27 that is perpendicular to an edge 30 of the substrate 22 and it can be seen that the width of the front region 26 is greater than the dimension (or length) of the region in the direction normal to the edge of the substrate 22. The front region 26 is formed contiguously with the rearward region 28, which is of smaller dimensions than the front region and has a width which is less than its length and which is less than the width of the front region 26.

Figure 2:
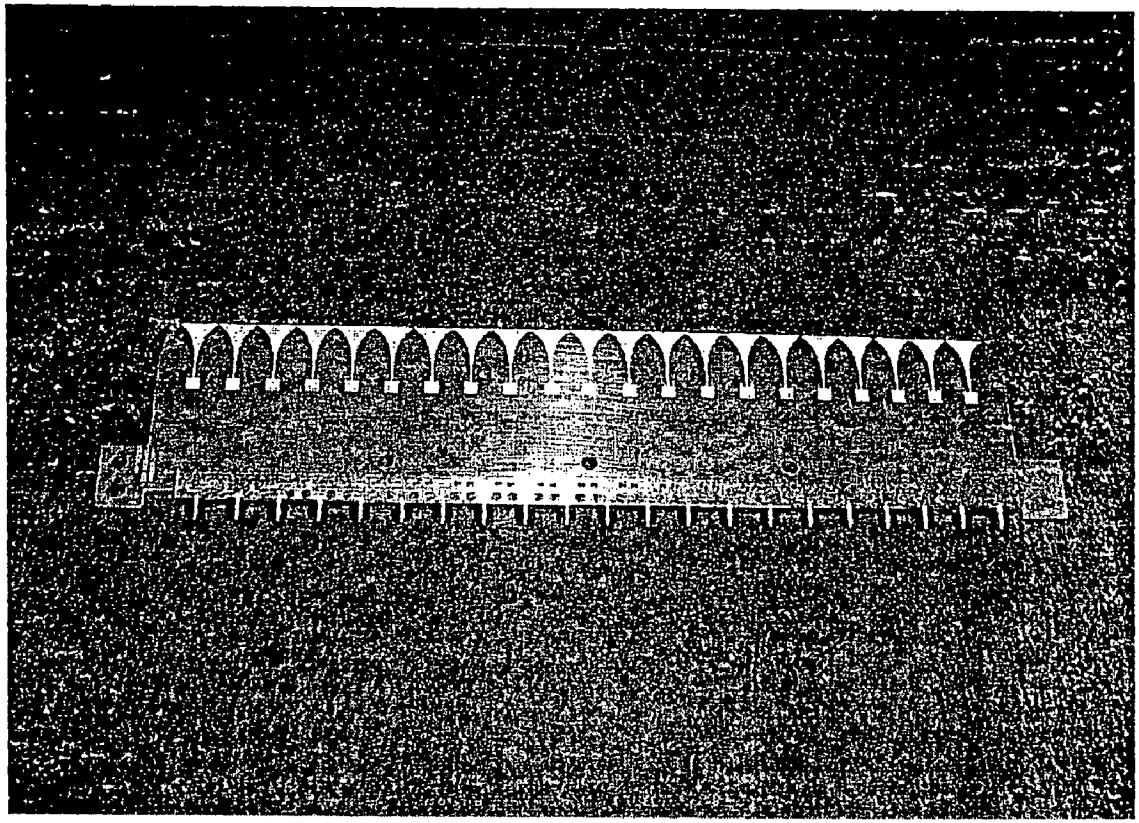
FIG. 2 PRIOR ART
FIG. 2 shows a view of an array antenna utilising the TSA or Vivaldi elements shown in FIG. 1, as known in the art.

The total length of each element 20, i.e. of the combined lengths of the front and rearward regions, is, as previously stated, less than ½ that of the Vivaldi element shown in FIG. 2. Nevertheless, the element can achieve bandwidths comparable to those available from the, much longer, Vivaldi element shown in FIGS. 1 and 2. The upper frequency limit of the bandwidth depends upon the spacing S between adjacent notch elements. The lower frequency limit depends on the size of the notch elements. In a rectangular grid, the element can achieve up to one octave bandwidth. The scan angles available are nominally a 60 degree half angle cone, although there are some frequencies and planes where the limit is closer to 50 degrees.

It was noted above that the upper frequency limit of an element is limited by the spacing between adjacent elements. A narrower spacing therefore means a increase in the upper frequency limit. However, as the grid spacing reduces, the metal between two elements reduces in width. Thus, an advantage of such an arrangement of elements is that it substantially maintains the lower frequency range, as the elements retain the same dimensions, but increases the higher frequency range as the spacing between the elements decreases, relative to a Vivaldi element.

An alternative arrangement of notch elements, according to a preferred embodiment of the present invention, can extend the frequency bandwidth of an antenna that includes such notch elements by removing conductive material altogether from between adjacent elements. This embodiment is shown in FIG. 4 where, as can be seen, no gap is left between the front notch elements formed by the electrically conductive coating on the surface of the substrate.

In this preferred embodiment, there is provided a plurality of notch elements 20 adjacent to one another in an array thereof. Each element 20 is formed by removing the coating from a substrate 22 coated with an electrically conductive material in a conventional manner. The elements formed are less than ½ the height of the comparable Vivaldi radiating element shown in FIG. 1 (i.e. have a length of approximately one half wavelength at the centre frequency). In this embodiment, it is to be understood that the substrate is formed as a laminate with a stripline sandwiched between the layers of the laminate. The layers of the laminate are provided by two printed circuit boards arranged in a back-to-back relationship and the reverse side (not shown in FIG. 4) of the laminate is substantially similar to the view shown in FIG. 4 as the elements are aligned on the two external surfaces. The external surfaces of the laminated substrate are electrically coupled by vias 23 extending through the substrate. It should be noted that the arrangement of the vias 23 is an arbitrary choice by a skilled designer, so other options than that shown are available.

As can be seen from FIG. 4, the notch elements 20 all comprise adjacent front regions 26, such that a continuous front region is formed, and a rearward, or inner, region 28. Both front and rearward, or inner, regions are rectangular in shape and are centred on an axis 29 that is perpendicular to an edge 30 of the substrate. It can be seen that the width of the front region 26 is greater than the dimension (or length) of the region in the direction normal to the edge of the substrate 22. The front region 26 is formed contiguously with the adjacent front regions 26. Further, the front region 26 is formed contiguously with the rearward region 28, which is smaller dimensions that the front region 26 and has a width which is less than its length and which is less than the width of the front region 26.

The total length of each element 20, i.e. of the combined lengths of the front region 26 and rearward region 28, is, as previously stated, less than ½ that of the Vivaldi element shown in FIG. 2. As the front regions 26 of the elements 20 are contiguous, the spacing between the elements is minimised, allowing a higher upper frequency limit than that provided in the aforementioned embodiment while retaining the lower frequency limit of the aforementioned embodiment as the size of the elements remain the same. It has been calculated that any array of these elements, and therefore an array comprising those elements, can function over an extended bandwidth of approximate frequency $f1<\text{frequency}<2.5\times f1$ over a full 60 degree cone.

Though the construction of the antennas of FIGS. 3 and 4 is created on a laminated substrate, it is to be clearly understood that the invention can be implemented by providing a notch element array on single surface only of a substrate with the required stripline (normally called a microstrip in this case) formed on a reverse face of the substrate from that on which the elements are formed.

The result of extending the bandwidth with elements arranged in an array antenna as described is that, by placing the elements in a grid at 90 degrees between vertical and horizontal array planes, the elements can also provide dual polarised wide band operation, as shown in FIGS. 5A and 5B where FIG. 5A is a diagrammatic illustration of notch element modules 52, 54 used in constructing a grid of modules as shown in FIG. 5B. Here vertical modules 54 and horizontal modules 52 are arranged in a grid pattern using metal posts 56 to secure the modules 52, 54 in place.

In order to obtain good cross-polarisation at all scan angles, the elements in such an array of elements needs to be less than $\lambda/2$ in length in the direction of the axis of symmetry. This provides improved cross-polar performance in comparison with the performance of a similar array of Vivaldi elements or an array of notch elements.

The invention claimed is:

1. A notch element for an array antenna, the notch element being formed on a substrate and comprising a front region and a rearward region, wherein the front region is adjacent to an edge of the substrate and is shaped as a symmetrical polygon having an axis of symmetry normal to the edge of the substrate, wherein the notch elements are situated directly adjacent to one another with no gap therebetween, and wherein the front region has a dimension parallel to the edge which is greater than its dimensional normal to the edge.

2. A notch element according to claim 1, wherein the rearward region is shaped as a polygon having an axis of symmetry normal to the edge of the substrate.

3. A notch element according to claim 2, wherein the axis of symmetry normal to the edge of the substrate is the same for both front and rearward regions.

4. A notch element according to any claim 1 the rearward region having a dimension parallel to the edge and a dimension normal to the edge, wherein the dimension parallel to the edge is smaller than the dimension normal to the edge.

5. A plurality of notch elements according to claim 1, formed on a substrate in a uniformly spaced arrangement.

6. A plurality of notch elements according to claim 5, wherein the notch elements are provided on only one surface of the substrate.

7. A plurality of notch elements according to claim 5, wherein an electrically conductive microstrip is provided for coupling the notch elements to a common source.

8. An antenna according to claim 5, wherein the notch elements are aligned along an edge thereof in said uniformly spaced arrangement.

9. A notch element for an array antenna, the notch element being formed on a substrate and comprising a front region and a rearward region, wherein the front region is adjacent to an edge of the substrate and is shaped as a symmetrical polygon having an axis of symmetry normal to the edge of the substrate, wherein the notch elements are situated directly adjacent to one another with no gap therebetween, wherein the front and rearward regions are both substantially rectangular.

10. A plurality of notch elements for an array antenna, the notch elements formed on a substrate in a uniformly spaced arrangement, each notch element being formed on a substrate and comprising a front region and a rearward region, wherein the front region is adjacent to an edge of the substrate and is shaped as a symmetrical polygon having an axis of symmetry normal to the edge of the substrate, wherein the notch elements are situated directly adjacent to one another with no gap therebetween, and wherein the substrate has opposed major surfaces, a layer of conductive material being provided on each major surface, and an array of said notch elements being formed by the layer of conductive material on each major surface so that the notch elements on each major surface are in alignment and in correspondence with the other.

11. A notch element for an array antenna, the notch element being one of multiple notch elements formed on a substrate and comprising a front region and a rear region, wherein the rear region is adjacent to an edge of the substrate and is plated with a conductor with a notch removed, said notch being shaped as a rectangle having an axis of symmetry normal to the edge of the substrate, wherein the notch elements are situated directly adjacent to one another with no gap therebetween, wherein the notch element has a length along the axis of symmetry that is less than ¾ of a free space wavelength at the highest operating frequency, wherein the front region is not plated with the conductor and is used to ensure that more than 90% of incident power is radiated when the element is used in a phased array antenna that scans up to 60 degrees from the axis of symmetry over an octave frequency band, wherein the element also provides a mechanism where most radiated power is radiated in a preferred polarization with minimum power radiated in an unwanted cross-polarization, wherein the phased array antenna scans either in a plane parallel to a substrate board, in a plane perpendicular to the substrate board, or in any plane therebetween over an octave frequency band, and wherein the notch element is fed either by one of an electrically conductive microstrip line and a stripline.

12. The notch element according to claim 11, wherein the conductor is copper.

13. A notch element according to claim 11, wherein bandwidth of the antenna, as defined by less than 10% of power reflected when operating in a phased array, is constant with a scan angle $\theta$ in a range $0° \geqq \theta \geqq 60°$ for any roll angle with respect to the horizontal axis.

* * * * *